United States Patent [19]

Vyhnal

[11] Patent Number: 4,548,065

[45] Date of Patent: Oct. 22, 1985

[54] STRETCH-FORMING TOOL

[75] Inventor: Richard F. Vyhnal, Tulsa, Okla.

[73] Assignee: Rockwell International Corporation, El Segundo, Calif.

[21] Appl. No.: 499,065

[22] Filed: May 27, 1983

[51] Int. Cl.[4] ..... B21D 37/02

[52] U.S. Cl. ..... 72/413; 72/482; 72/478; 72/296

[58] Field of Search ..... 72/296, 295, 302, 301, 72/482, 481, 413, 478

[56] References Cited

U.S. PATENT DOCUMENTS

| | | | |
|---|---|---|---|
| 438,413 | 10/1890 | Groves | 72/478 |
| 504,628 | 9/1893 | Senger | 72/413 |
| 1,178,020 | 4/1916 | Leonard . | |
| 1,321,895 | 11/1919 | Damerell . | |
| 1,741,840 | 12/1929 | Harmon et al. | 72/295 |
| 2,406,182 | 8/1946 | Zeitz | 72/383 |
| 2,433,808 | 12/1947 | Cadman | 72/301 |
| 2,483,957 | 10/1949 | Wright . | |
| 2,518,867 | 8/1950 | Clary | 29/173 |
| 2,549,002 | 4/1951 | Parsons et al. . | |
| 2,729,265 | 1/1956 | Jones | 72/478 |
| 2,754,708 | 7/1956 | Peterson | 81/38 |
| 2,868,264 | 1/1959 | Jones | 72/296 |
| 3,181,331 | 5/1965 | Wishing | 72/478 |
| 3,426,569 | 2/1969 | Brauer et al. | 72/413 |
| 3,616,676 | 11/1971 | Takeyasu | 72/481 |
| 3,868,102 | 2/1975 | Pevar | 269/26 |
| 4,292,834 | 10/1981 | Tishler et al. | 72/482 |

FOREIGN PATENT DOCUMENTS

| | | | |
|---|---|---|---|
| 10808 | of 1845 | United Kingdom | 72/413 |

*Primary Examiner*—Daniel C. Crane
*Attorney, Agent, or Firm*—Charles T. Silberberg; Morland Fischer

[57] ABSTRACT

A stretch-forming tool to provide a variable tool contour for the stretch-wrap forming and joggling of extrusions of aluminum, or the like, to any of a variety of different contours. The present tool comprises a base plate in which a plurality of elongated slots of variable length are cut. An array of position variable form blocks are respectively connected to the base plate at the slots formed therein. Each of the form blocks is adapted to ride through a respective slot to assume a particular position, relative to other form blocks of the array, whereby to define a desired net contour. The form blocks are particularly aligned relative to one another by means of a template. The template is shaped so as to correspond to the configuration of the final production part, either precisely or approximately, depending on whether compensation for springback is to be included. A workpiece is stretched around the array of form blocks until permanent deformation occurs therein at a desired contour, depending upon the alignment of the form blocks on the base plate.

6 Claims, 8 Drawing Figures

STRETCH-FORMING TOOL

BACKGROUND OF THE INVENTION

1. Field of the Invention

This invention relates to an adjustable tool to enable the stretch-wrap forming and joggling of a plurality of different workpieces by which to form a variety of contours therein. The invention has particular application in an aircraft production program which requires stretch-formed contours of extruded, roll-formed, or break-formed pieces of aluminum, and the like metals, in either of a tee, ell, or channel section.

2. Prior Art

As will be known to those skilled in the art, stretch-forming of aluminum extrusions to provide stringers for use in aircraft construction, or the like, has proven to be both a time consuming and relatively expensive procedure. More particularly, the conventional stretch-wrap forming technique commonly requires a relatively complex hard tooling process in which a particular die, or the like, is designed and constructed to fabricate each separate component part and, frequently, left and right-handed versions of the same part. A die is attached to a work surface and the workpiece is stretched over the die until permanent deformation occurs. The hard tooling system is typically fabricated to the net contour of the desired configuration with no allowance for springback. Inasmuch as springback is a consequence of all known stretch forming processes, parts formed to a net contour will generally not conform to the designed shape. When such non-conformance is beyond acceptable limits, additional expense and time delays are incurred, requiring either a modification in the processing sequence (i.e., forming the part both before and after an intermediate heat treatment step) or a reworking of the tool to compensate for springback.

Moreover, the cost to implement a conventional hard tooling system is typically the same, whether the system is used numerous times or a very few times. Hence, such considerations as described above make a conventional hard tooling system inefficient, inasmuch as a different hard tool may be required for each production part. Where a large number of different component parts is required for production, the cost and inconvenience (e.g. complexity, space consumption, and required workman skills) by which to implement a hard tooling system is undesirably maximized, especially when a different tool is required for each of the different parts.

Known to the prior art are various shaping devices having a plurality of movable members or clamping devices which adjustably interact with one another in a process for forming aircraft components, and the like. By way of example, U.S. Pat. No. 1,178,020 published Apr. 4, 1916, discloses a template in which heated spring stock is formed for shaping leaf springs.

U.S. Pat. No. 2,483,958 published Oct. 4, 1949, relates to a welding machine and means for guiding an automatic welding head along a welding path by means of a guide associated with a workpiece. U.S. Pat. No. 2,578,867 published Aug. 15, 1950, describes a method for manufacturing leaf springs by means of a hydraulically actuated bending machine that bends a heated spring assembly.

U.S. Pat. No. 3,616,676 published Nov. 2, 1971, discloses a jig device for bending ship plates by which the curvature of a resilient jig strap can be adjusted.

U.S. Pat. No. 3,868,102 published Feb. 25, 1975, describes a clamping device in which multiple, movable engaging elements are employed for applying clamping forces to flat and contoured objects.

Additional U.S. patents which generally describe adjustable clamping devices to interact with a workpiece are as follows:

| U.S. Pat. No. | Date Published |
|---|---|
| 1,321,895 | November 18, 1919 |
| 2,549,002 | April 17, 1951 |
| 2,754,708 | July 17, 1956 |

However, no patents are known in the prior art which show or suggest a stretch forming tool having an array of position-variable form blocks respectively connected to a plurality of elongated slots formed in a base plate, so that a workpiece can be stretch formed to any of a variety of different contours around the form blocks depending upon the positions of the form blocks in the respective slots.

SUMMARY OF THE INVENTION

Accordingly, it is a primary object of the present invention to provide an adjustable stretch-forming tool having a variable tool contour for enabling the stretch-wrap forming of a workpiece to any of a corresponding variety of contours while avoiding the problems inherent in a conventional hard tooling and die process.

It is another object of this invention that the present stretch-forming tool minimize the cost and reduce the time by which to develop the tooling for a program to manufacture new production parts.

It is a further object of this invention that the present stretch-forming tool be capable of reducing the flow time associated with a program of tool design and fabrication.

It is a still further object of this invention that the present stretch-forming tool be particularly adapted to make slight revisions in the contour of the workpiece by utilizing a modified component in the tooling (e.g. a set-up template to control overall workpiece contour) rather than requiring a different tool or a major modification to an existing tool.

It is yet another object of this invention that the present stretch-forming tool include a pair of templates (including the aforementioned set-up template) which are respectively shaped to define the final net contour of the workpiece and compensate for springback of the workpiece during the stretch-forming thereof.

It is still another object of this invention that the present stretch-forming tool include joggling means which are capable of forming a joggle of variable angle and shape in the workpiece.

These and other objects of the invention, as well as various novel features and the advantages thereof, will be apparent from the following description of the preferred embodiment, reference being made to the accompanying drawings, wherein:

DESCRIPTION OF THE PREFERRED EMBODIMENT

Figure 1:
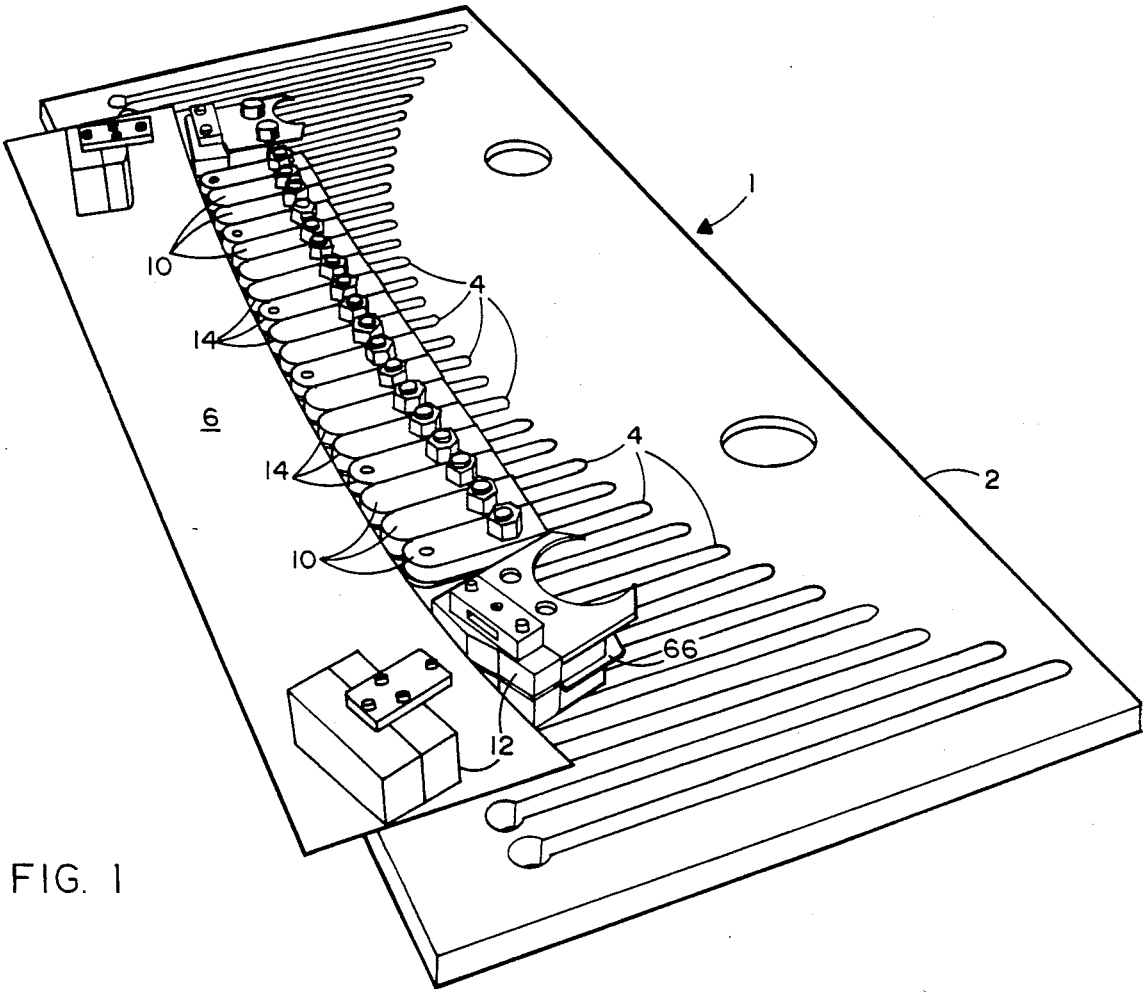
FIG. 1 is an isometric view of the stretch-forming tool which forms the present invention.

Referring to the drawings, FIG. 1 shows the presently disclosed stretch-forming tool 1 in the assembled relationship, so as to receive a workpiece therein. Stretch-forming tool 1 comprises a base plate 2 having an array of slots 4 formed therethrough. Located on base plate 2 are a plurality of form blocks 10. Each form block 10 terminates at a rounded nose point 14 at which to contact a workpiece (not shown). Form blocks 10 (the details of which will be disclosed in greater detail hereinafter when referring to FIG. 4) are adapted to ride through respective slots 4, whereby the positions of form blocks 10 are variable over the face of base plate 2. By selectively varying the positions thereof, the form blocks 10 can be utilized to create a desired contour in the workpiece.

A female template 6, formed from sheet metal, or the like, is positioned on the face of base plate 2 to establish the approximate alignment for each of the form blocks 10 in respective slots 4, whereby to produce the desired net contour when a workpiece is stretch-formed around the nose points 14 thereof. It is to be understood that template 6 is shown in FIG. 1 for purposes of illustration only, and after form blocks 10 are suitably aligned to produce the desired contour, the template 6 is removed from the base plate 2 prior to the stretch forming operation. A male template 66 (best described when referring to FIG. 4 of the drawings) is also formed from sheet metal, or the like, and inserted between top and bottom halves of the form blocks 10, so as to establish the precise alignment for each of the form blocks and create a gap therein for receiving and securing at the gap a workpiece to be stretch-formed. Each of female and male templates 6 and 66 are fabricated according to conventional techniques and correspond to a full size production part with the desired final contour formed therein. The shapes of templates 6 and 66 are modified to compensate for springback allowances as well as for the inclusion of shim straps and bevel straps (best described when referring to FIG. 6 of the drawings).

Stretch-forming tool 1 may also include one or more (e.g. a pair of) position-variable joggle units 12 (described in greater detail hereinafter when referring to FIGS. 7 and 8 of the drawings). The joggle units are shown interfaced with slots 4 and located on the face of base plate 2 at opposite ends of the array of form blocks 10. However, it is to be understood that the joggle units could be located at other positions relative to a workpiece. The precise alignment of joggle units 12 with form blocks 10 is also established by means of template 6. Each joggle unit 12 comprises left and right mating halves between which the workpiece is to be permanently deformed by an externally applied clamping force. The joggle halves contain the profile of the particular joggle, which profile may include compensation for springback, if required. After a workpiece is stretched around the nose points 14 of form blocks 10 so as to introduce therein a permanent deformation at a desired contour (depending upon the alignment of form blocks 10 on base plate 2), a sufficient clamping or compressive force may be applied to joggle units 12 so as to cause a desired joggle to be formed in the workpiece.

Figure 2:
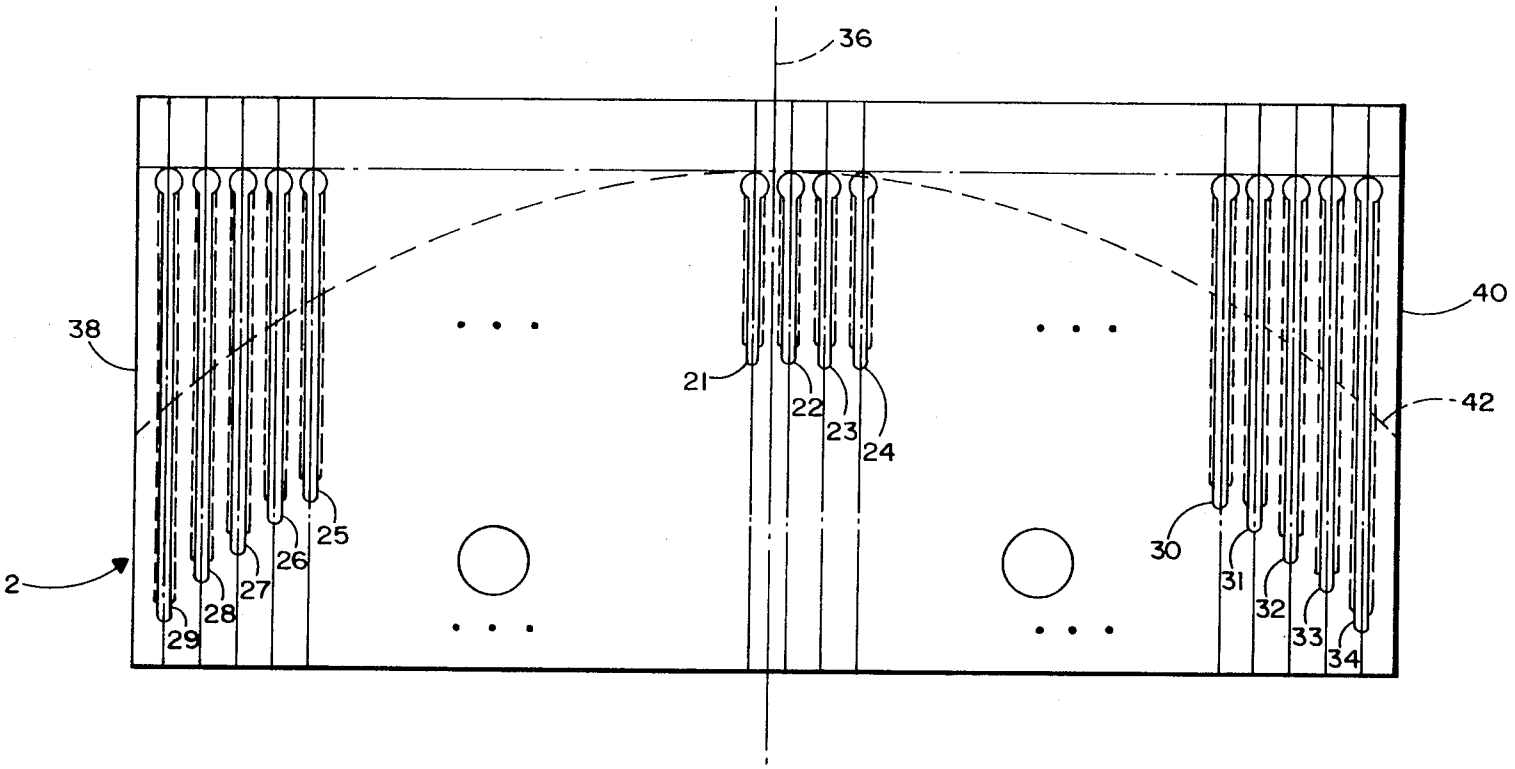
FIG. 2 is a top view of a base plate which forms the stretch-forming tool of FIG. 1.

Referring now to FIG. 2 of the drawings, the base plate 2 of the stretch-forming tool 1 of FIG. 1 is described in detail. Although not to be considered a limitation of the present invention, base plate 2 is preferably a rectangular, metal (e.g. steel) plate having a thickness of approximately two inches and a length and width of suitable dimension so as to accommodate therethrough a plurality of slots or machined cuts (only a selected few 21–34 of which being shown). The slots 21–34 are arranged in parallel alignment relative to one another across the face of base plate 2. In a preferred embodiment of the invention, the lengths of successively aligned slots increase as the location of the slots moves away from a center line (e.g. a reference line designated 36) of the base plate 2. That is, those slots (e.g. 21 and 22) that are located near the center of base plate 2 are provided with the shortest lengths, while those slots (e.g. 25–29 and 30–34) which are located near the ends 38 and 40 of base plate 2 are provided with the longest lengths. More particularly, the slots designated 29 and 34, which slots are located immediately adjacent the respective ends 38 and 40 of base plate 2, are characterized by a substantially identical length relative to one another and a length which is the longest of any slot in the plurality thereof. The slots designated 21 and 22, which slots are located immediately adjacent the center line 36 of base plate 2, are characterized by a substantially identical length relative to one another and a length which is the shortest of any slot in the plurality thereof. As will be disclosed in greater hereinafter, a primary advantage of varying the lengths of successively aligned slots 21–34 is to permit an array of form blocks to be respectively positioned in the slots 21–34, such that a workpiece (not shown) can be stretch-formed to any of a variety of contours (e.g. one of which being designated by reference curve 42) depending upon the location of the form blocks within the respective slots. That is, the slots (e.g. 29 and 34) characterized by the longest length are adapted to permit the greatest longitudinal movement of a respective form block therein and, correspondingly, the greatest degree of curvature to be applied to a workpiece. However, it is to be understood that the slots formed in base plate 2 could also be of identical length relative to one another, and no limitation is intended by the foregoing description.

Figure 3:
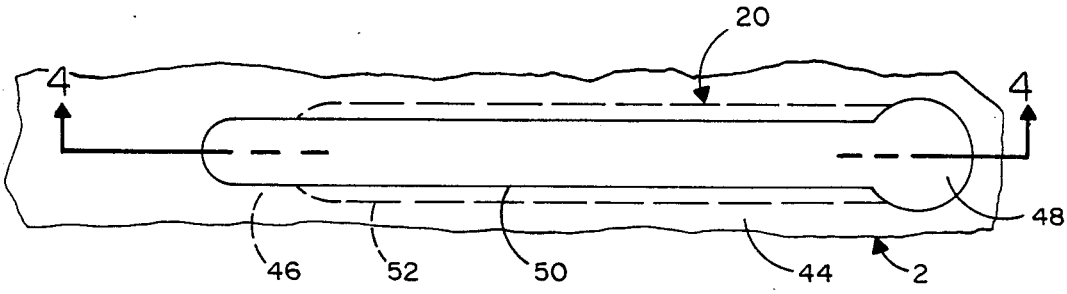
FIG. 3 illustrates the details of an elongated slot, a plurality of which are formed in the base plate of FIG. 2.
Figure 4:
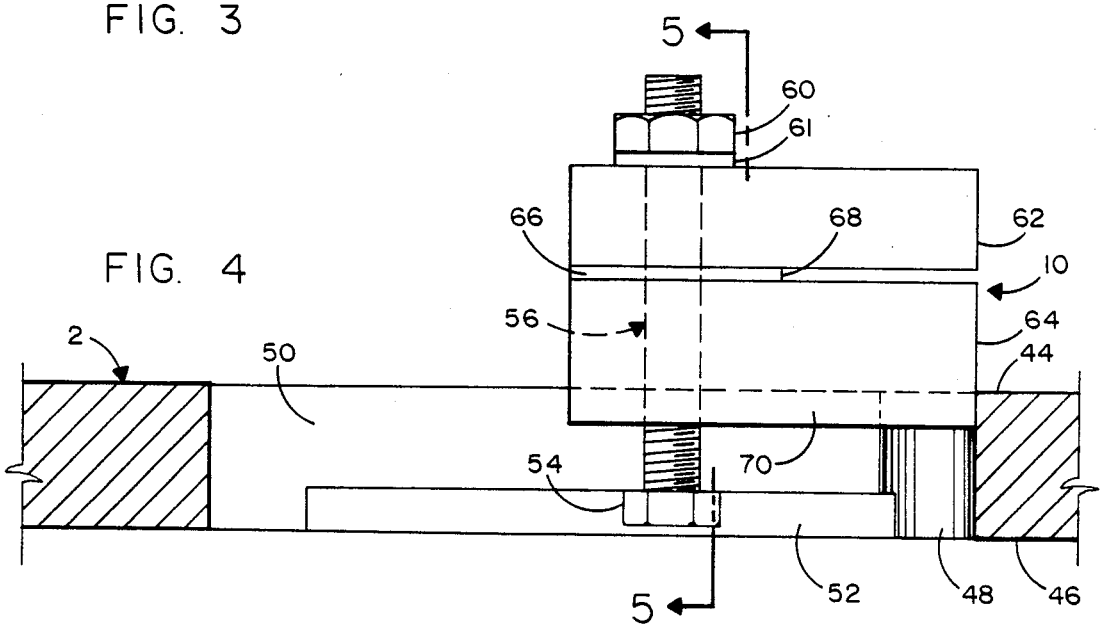
FIG. 4 is a cross-section of a slot taken along lines 4—4 of FIG. 3 with the inclusion of a forming block and fastening means therefor.

The details of the configuration of one slot from the plurality of similar slots (of FIG. 2) which extend across base plate 2 is best described while referring concurrently to FIGS. 3 and 4 of the drawings. Each slot (e.g. 20) is an elongated cut of relatively narrow dimension with a head portion 48 located at one end thereof. The head portion 48 of slot 20 is preferably a circular hole which extends completely through base plate 2. As is best shown in FIG. 3, an area 50 of slot 20 which extends upwardly through the top surface 44 of base plate 2 is of a smaller width than the width of an area 52 of slot 20 which extends downwardly through the bottom surface 46 of base plate 2, the advantage of which will soon be described.

More particularly, the circular head portion 48 of slot 20 is suitably sized, so as to accommodate therethrough the head 54 of a conventional bolt 56 (best shown in FIG. 4). As will be disclosed in greater detail hereinafter while referring to FIG. 5 of the drawings, the bolt 56 is utilized to removably connect a form block 10 to base plate 2 at a respective slot 20. The bottom area 52 of slot 20 is of sufficient size (i.e. width) to allow the head 54 of bolt 56 to slide longitudinally therethrough. However, the top area of slot 20 is of reduced size (i.e. width) relative to the size of bolt head 54 so as to prevent the accidental or intentional withdrawal of bolt 56 and form block 10 from slot 20. A sheet metal cover (not shown) may be connected across the underside of base plate 2 to prevent the bolts 56 from falling downwardly and outwardly of base plate 2 through respective slots therein.

Accordingly, a workman may easily attach a form block 10 to a respective slot 20 at base plate 2 by simply inserting the head 54 of bolt 56 through the circular hole 48 at the top surface 44 of base plate 2. The form block 10 can be moved longitudinally through the slot 20 until block 10 is suitably located at a desired position (relative to other form blocks), so as to be capable of producing a particular curvature in a workpiece that is to be stretch-formed therearound. Once a form block 10 is suitably located in slot 20, a nut 60 and washer 61 are tightened down against block 10 at an end of bolt 56 which lies opposite the head 54 so as to prevent an inadvertent movement of block 10 through slot 20. By making the width of the bottom area 52 of slot 20 only slightly larger than bolt head 54, bolt 56 will be unable to rotate in slot 20. Moreover, during the tightening of nut 60 and washer 61, the formation of slot 20 and the bottom area 52 thereof prevent the rotation of bolt 56 during the torquing of nut 60. By virtue of the present means for interconnecting a form block 10 to a respective slot 20, a workman is able to operate completely above the top surface 44 of base plate 2 without the necessity of going underneath base plate 2 when inserting bolt 56 therethrough.

Figure 5:
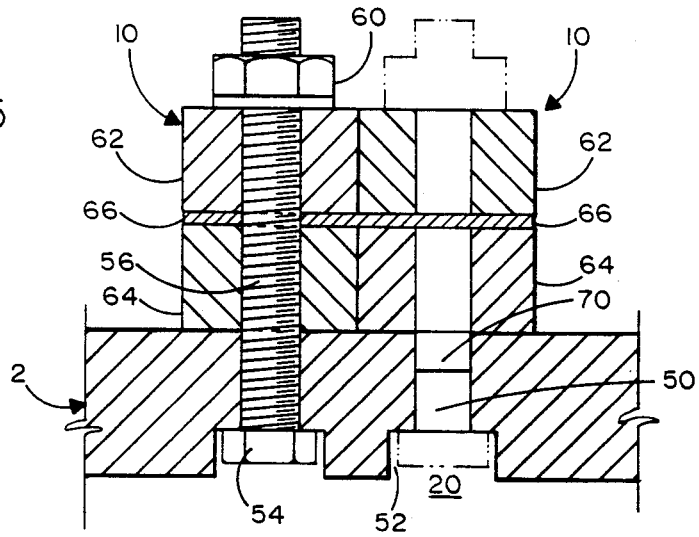
FIG. 5 is a cross-section of a pair of forming blocks taken along lines 5—5 of FIG. 4.

The details of the configuration for one form block 10 from a plurality of identical form blocks of FIG. 1 are best disclosed while referring concurrently to FIGS. 4 and 5 of the drawings. Each form block 10 comprises upper and lower halves 62 and 64 and a tail 70, which tail 70 is coextensively formed with lower half 64. As is best shown in FIG. 4, a gap separating the form block halves is established by a thin metal shim 66 (i.e. the male template of FIG. 1). Template 66 provides a hard riding surface 68 located at one end thereof by which to engage and provide lateral support for the standing leg (not shown) of a piece of tee extrusion during the stretch-forming of such extrusion by means of the presently disclosed stretch-forming tool. Close-tolerance holes are bored in upper and lower form block halves 62 and 64 and shim 66 so as to accommodate a bolt 56 therethrough when connecting a form block 10 to a respective slot 20, as previously disclosed.

The tail 70 of form block 10 comprises an extension of lower block half 64. That is, tail 70 is coextensively formed with and extends downwardly from the bottom surface of lower form block half 64. Tail 70 is of suitable dimension to be received within and ride through a path established by the area 50 of slot 20 at the top surface 44 of base plate 2. Thus, area 50 provides a guide or track for receiving tail 70, whereby to facilitate the positioning of form block 10 at a desired location along the path of slot 20 and prevent the rotation of form block 10 under forming loads. Accordingly, each of the plurality of form blocks 10 is suitably aligned on base plate 2, so that bolts (e.g. identical to bolt 56) can be inserted therethrough and through respective holes in template 66, whereby to preserve the intended net contour as established by template 6 (of FIG. 1).

Figure 6:
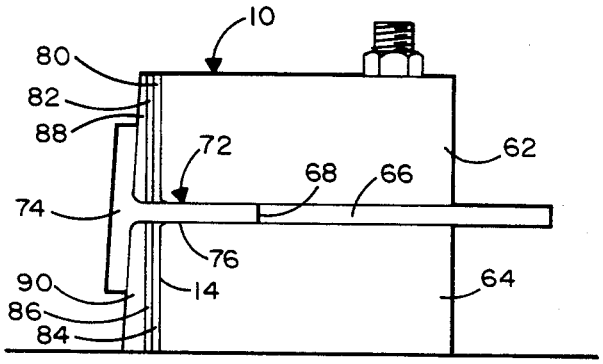
FIG. 6 is a side view of a forming block with a tee shaped workpiece attached thereto.

Referring now to FIG. 6 of the drawings, a workpiece 72 is shown secured between the upper and lower halves 62 and 64 of a form block 10. More particularly, workpiece 72 is a tee section formed from an extrusion of aluminum, or the like, and comprising a tee cap 74 and a standing leg 76, which cap and leg are shown aligned with one another at an angle. Although workpiece 72 is described herein as a tee section, the present invention, with minor modifications, also has application to stretch-forming ell sections, channel sections, and the like, and no limitation of this invention should be inferred because of the shape of the workpiece disclosed herein. Standing leg 76 of tee section 72 is located between form block halves 62 and 64 and positioned so as to contact the riding surface 68 of template 66. One or more (e.g. two) elongated upper shim straps 80 and 82 and a corresponding number of elongated lower shim straps 84 and 86 are aligned face-to-face one another above and below standing leg 76 and adjacent the round nose point 14 of each form block 10. Upper and lower shim straps 80, 82, 84 and 86 are typically of uniform thickness and fabricated from a tempered spring steel material. Shim straps 80, 82, 84 and 86 function to provide a smooth contour and prevent mark-off or indentation in the tee cap 74 of workpiece 72, whereby to avoid direct contact between tee cap 74 and the nose points 14 of form blocks 10.

In the event that the angle to be formed between the tee cap 74 and standing leg 76 of tee section 72 is other than a right angle (which angle may vary or remain constant along the entire length of a finished part), upper and lower elongated bevel straps 88 and 90 may be utilized to cause such desired angle. Upper and lower bevel straps 88 and 90 are respectively positioned above and below standing leg 76 and between the shim straps and the tee cap 74. To facilitate machining, bevel straps 88 and 90 are preferably fabricated from an aluminum material and are of a tapered thickness corresponding to the angle which is to be formed between tee cap 74 and standing leg 76. More particularly, if the upper bevel strap 88 is thinner than the lower bevel strap 90 (or vice versa), a corresponding angle (other than a right angle) can be conveniently formed between tee cap 74 and standing leg 76. Inasmuch as the bevel straps 88 and 90 can be machined in the flat (rather than around a contour, as is otherwise required by the conventional hard tooling techniques), the present invention affords both an easier and faster tool fabrication procedure than that heretofore available with an existing hard tool system.

In the assembled relationship (of FIG. 1), the shim straps 80, 82, 84, 86 and bevel straps 88 and 90 are of sufficient length to pass the nose points of each of the plurality of form blocks 10. However, to avoid interference of the shim and bevel straps with the soon to be described joggling process, the strap lengths terminate prior to the location on base plate 2 of the joggle units (designated 12 in FIG. 1). Accordingly, the joggle units must be particularly positioned on base plate 2 by means of template 6, so as to compensate for the absence of shim and bevel straps. Moreover, if tapered bevel straps 88 and 90 are employed, as previously disclosed, the faces of joggle units 12 (in FIG. 8) must have the corresponding taper machined therein, so that workpiece 72 can be formed with a desired angle.

The joggle units are machined according to a conventional hard tooling technique so as to include the same angle (corresponding to the angle between tee cap 74 and standing leg 76 of tee section 72) as is provided by bevel straps 88 and 90. What is more, and as will be disclosed in greater detail hereinafter when referring to FIGS. 7 and 8 of the drawings, the joggle units 12 may be adapted to receive different workpieces in which a variety of different angles can be formed.

Figure 7:
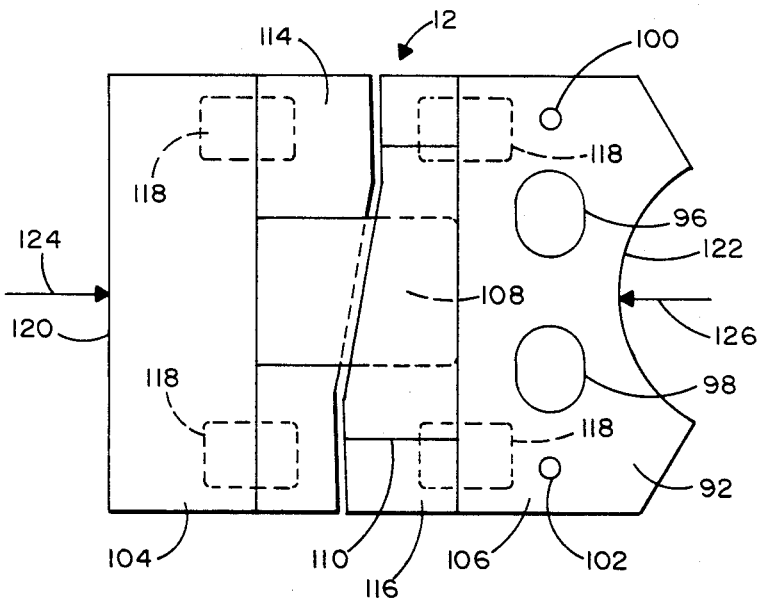
FIG. 7 is a top view of a joggle unit which forms the stretch-forming tool of FIG. 1.
Figure 8:
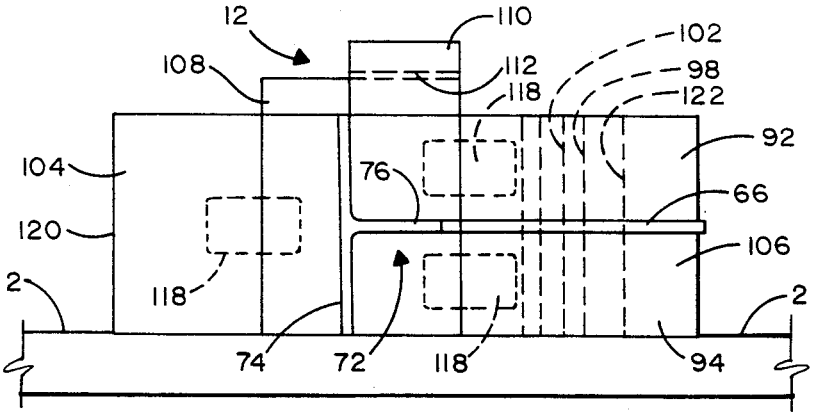
FIG. 8 is a side view of the joggle unit of FIG. 7.

A joggle unit 12 is now described in detail while referring concurrently to FIGS. 7 and 8 of the drawings. As is best shown in FIG. 8, joggle unit 12 comprises left and right mating halves 104 and 106. The right half 106 of joggle unit 12 includes top and bottom blocks 92 and 94. A pair of elongated holes 96 and 98 are machined through the joggle blocks 92 and 94 of right joggle half 106 to accommodate a respective pair of suitably dimensioned bolts (not shown) and thereby secure joggle blocks 92 and 94 together and to a corresponding pair of slots formed in the base plate 2. The template 66 (extending between upper and lower form block halves 62 and 64 in FIG. 6) is of sufficient length to also extend between upper and lower joggle blocks 92 and 94. The pair of holes 96 and 98 is also machined through template 66 so as to receive the aforementioned bolts therethrough. The thickness of template 66 establishes a gap of suitable dimension between joggle blocks 92 and 94 to accommodate the standing leg 76 of workpiece tee section 72. Template 66 and upper and lower joggle blocks 92 and 94 have a pair of holes 100 and 102 machined therethrough to respectively accommodate suitably dimensioned tool pins (not shown). Accordingly, and as previously disclosed when referring to FIG. 1, template 66 functions to properly align joggle unit 12 with form blocks 10. That is, the final alignment of a joggle unit 12 is accomplished by inserting tool pins into holes 100 and 102 so as to extend through upper joggle block 92 and template 66 and into lower joggle block 94. The bolts which extend through holes 96 and 98 are then tightened so as to preserve the position of joggle unit 12 at base plate 2.

The left and right halves 104 and 106 of joggle unit 12 are to be moved into engagement with one another, whereby to secure the tee cap 74 of tee section 72 therebetween. A tang 108 is connected to the top of left joggle half 104. Tang 108 extends outwardly from left joggle half 104 in a direction towards right joggle half 106. A receptacle block 110 extends upwardly from the top of right joggle half 106. A hollow pocket 112 is formed in receptacle block 110 and dimensioned so as to receive tang 108 therein. The bottom of left joggle half 104 is a smooth, flat surface, whereby to permit joggle half 104 to rest upon and be easily and freely moved across base plate 2 towards the right joggle half 106 until the tang 108 of joggle half 104 is positioned at the pocket 112 in the receptacle block 110 of joggle half 106. The mating of tang 108 with receptacle block 110 as will be hereinafter described permits the left and right joggle block halves 104 and 106 to be connected together, whereby to complete the joggling process.

As previously disclosed, each joggle unit 12 may be adapted to receive a variety of workpieces 72 in which a variety of angles can be formed between the standing leg 74 and tee cap 76 thereof. More particularly, when the angle of workpiece 72 is to be other than a right angle, different pairs of joggle faces 114 and 116 would typically be required for right and left-handed counterparts of each production part. However, and by virtue of the present invention, the desired angle for either the right or left-handed counterpart is machined into the respective faces 114 and 116 of the left and right halves 104 and 106 of joggle unit 12. To permit the opposite hand to be formed with relative ease and a minimum of time expenditure, faces 114 and 116 are removably connected to respective left and right joggle halves 104 and 106 by means of dowel pins 118 (shown in phantom). Dowel pins are preferably circular machine fit pins that are interconnected between joggle faces 114 and 116 and respective left and right joggle halves 104 and 106 at suitably dimensioned apertures formed therein. Thus, joggle faces in which different angles are machined may be easily interchanged with one another, so as to facilitate the formation of the right and left-handed counterparts with a minimum number of tooling changes. Of course, the orientation of the top and bottom bevel straps (88 and 90 of FIG. 6) must also be reversed to form both counterparts of a production part.

Joggle unit 12 has a pair of force receiving ends. As is best shown in FIG. 7, a first force receiving end 120 is a flat outward end of left joggle half 104. The second force receiving end 122 is a semi-circular outward end of right joggle half 106. In operation, and referring once again to FIGS. 7 and 8, the workpiece is grasped at each end thereof and stretched (e.g. by means of a conventional hydraulic press) around the contour created by the form blocks until permanent deformation is obtained. The joggling operation is accomplished by locating the left half 104 of joggle unit 12 with the right joggle half 106 thereof by means of tang 108, as previously disclosed. A well-known and commercially available overhead clamping-type press (not shown) is moved into alignment with the force receiving outward ends 120 and 122 of joggle unit 12, and a compressive force is supplied thereto (in the directions of arrows 124 and 126) until the joggle is formed in the workpiece 72. More particularly, the semi-circular outward end 122 of right joggle half 106 is shaped so as to receive therein a cylindrical member (also not shown) of the clamping press. Another member of the clamping press engages the flat outward end 120 of left joggle half 104. When the press is activated, force is applied to joggle unit 12 in the directions 124 and 126, such that the tang 108 of left joggle half 104 is moved into the pocket 112 and left joggle half 104 is moved into contact with the workpiece against right joggle half 106. Thus, the workpiece 72 is formed with the angle which has been established by tapered bevel straps 88 and 90 of FIG. 6 and the angle which is machined into joggle faces 114 and 116.

It will be apparent that while a preferred embodiment of the invention has been shown and described, various modifications and changes may be made without departing from the true spirit and scope of the invention.

Having thus set forth the preferred embodiment, what is claimed is:

1. Apparatus for stretch-forming a sheet metal workpiece to a desired contour, said apparatus comprising:

a base plate having a plurality of substantially parallel slots therein, said base plate having a face;

a plurality of forming blocks each having an upper segment and a lower segment, said lower segment having a portion slidably received in one of said slots, said upper and lower segments each having a frontal portion defining respective forming surfaces for said blocks extending transverse to the base plate face;

a template located between respective upper and lower segments of said plurality of forming blocks for establishing therebetween a gap in which a portion of the workpiece is inserted, said template having a configuration substantially conforming to the desired thickness of said workpiece portion and aligning each of the upper and lower segments of each forming block so that the respective forming surfaces thereof define the desired contour;

connecting means extending through registering apertures in said template and in the upper and lower segments of each of said forming blocks for detachably connecting said upper and lower segments together with said template located therebetween, said connecting means having first ends to be received within respective slots for adjustably fixing the positions of said forming blocks along said slots so as to define the desired workpiece contour; and joggle means comprising first and second position variable joggling sections for receiving a portion of the workpiece therebetween, said first joggling section being received by at least one of the slots in said base plate so as to be aligned with said forming blocks, and said second joggling section being movable on the face of the base plate into mating complementary engagement with said first joggling section for forming a deformation in the workpiece corresponding to the desired countour when clamping forces are applied to respective force receiving ends of said joggling sections.

2. The apparatus of claim 1, wherein said slots are graduated in length from the center of said base plate to each of opposite sides thereof.

3. The apparatus of claim 1, further comprising elongated strap means, positioned on the forming surfaces of said forming blocks, for providing a continuous contour in said workpiece and preventing damage thereto when said workpiece is stretch-formed over said forming blocks.

4. The apparatus of claim 3, wherein said elongated strap means has a tapered cross-section.

5. The apparatus of claim 1, wherein said connecting means have second ends which extend upwardly from the upper segments of respective forming blocks, and fastening means engaging said second ends for removably securing said connecting means in the apertures through said template and and said forming block segments, the first ends of said connecting means having a dimension which is greater than a corresponding dimension of said slots, so as to prevent the removal of said connecting means from said slots without the prior removal of said fastening means from said first connecting means ends.

6. The apparatus of claim 1, wherein each of said joggling sections has a respective face removably connected thereto, said faces having a profile of the deformation to be formed in the workpiece.

* * * * *